US007473326B2

(12) United States Patent
Kobayashi et al.

(10) Patent No.: US 7,473,326 B2
(45) **Date of Patent: *Jan. 6, 2009**

(54) NI-BASE DIRECTIONALLY SOLIDIFIED SUPERALLOY AND NI-BASE SINGLE CRYSTAL SUPERALLOY

(75) Inventors: Toshiharu Kobayashi, Ibaraki (JP); Yutaka Koizumi, Ibaraki (JP); Tadaharu Yokokawa, Ibaraki (JP); Hiroshi Harada, Ibaraki (JP); Yasuhiro Aoki, Tokyo (JP); Shouju Masaki, Tokyo (JP)

(73) Assignees: National Institute for Materials Science, Ibaraki (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 423 days.

This patent is subject to a terminal disclaimer.

(21) Appl. No.: 10/509,427

(22) PCT Filed: Mar. 27, 2003

(86) PCT No.: PCT/JP03/03885

§ 371 (c)(1),
(2), (4) Date: Nov. 18, 2004

(87) PCT Pub. No.: WO03/080882

PCT Pub. Date: Oct. 2, 2003

(65) Prior Publication Data

US 2005/0092398 A1 May 5, 2005

(30) Foreign Application Priority Data

Mar. 27, 2002 (JP) ..... 2002-090018

(51) Int. Cl.
*C22C 19/07* (2006.01)

(52) U.S. Cl. ..... 148/404; 148/428; 420/444

(58) Field of Classification Search ..... 148/404, 148/428; 420/444
See application file for complete search history.

(56) References Cited

U.S. PATENT DOCUMENTS

| | | | | | |
|---|---|---|---|---|---|
| 4,222,794 | A | * | 9/1980 | Schweizer et al. | 148/555 |
| 4,459,160 | A | * | 7/1984 | Meetham et al. | 148/562 |
| 4,707,192 | A | * | 11/1987 | Yamazaki et al. | 148/555 |
| 4,801,513 | A | | 1/1989 | Duhl et al. | |
| 4,849,030 | A | * | 7/1989 | Darolia et al. | 148/562 |
| 4,975,124 | A | * | 12/1990 | Ault | 148/562 |
| 5,482,789 | A | * | 1/1996 | O'Hara et al. | 428/652 |
| 6,007,645 | A | * | 12/1999 | Cetel et al. | 148/404 |
| 6,966,956 | B2 | * | 11/2005 | Koizumi et al. | 148/428 |

FOREIGN PATENT DOCUMENTS

| | | | |
|---|---|---|---|
| EP | 0663462 | A1 | 7/1995 |
| EP | 789087 | A1 | 8/1997 |

* cited by examiner

*Primary Examiner*—George Wyszomierski
(74) *Attorney, Agent, or Firm*—Wenderoth, Lind and Ponack, L.L.P.

(57) ABSTRACT

A Ni-base directionally solidified superalloy and a Ni-base single-crystal superalloy, which have superior creep strength at a high temperature, consists essentially of from 5.0 percent by weight to 7.0 percent by weight of Al, from 4.0 percent by weight to 16.0 percent by weight of Ta+Nb+Ti, from 1.0 percent by weight to 4.5 percent by weight of Mo, from 4.0 percent by weight to 8.0 percent by weight of W, from 3.0 percent by weight to 8.0 percent by weight of Re, 2.0 percent by weight or less of Hf, 10.0 percent by weight or less of Cr, 15.0 percent by weight or less of Co, from 1.0 percent by weight to 4.0 percent by weight of Ru, 0.2 percent by weight or less of C, 0.03 percent by weight or less of B, and Ni and inescapable impurities as a balance. The superalloys can be used for a turbine blade, a turbine vane and the like of a jet engine, an industrial gas turbine and the like.

12 Claims, 3 Drawing Sheets

NI-BASE DIRECTIONALLY SOLIDIFIED SUPERALLOY AND NI-BASE SINGLE CRYSTAL SUPERALLOY

TECHNICAL FIELD

The present invention relates to a Ni-base directionally solidified superalloy and a Bi-base single crystal superalloy. More particularly, the present invention relates to a new Ni-base directionally solidified superalloy and a new Ni-base single-crystal superalloy, both of which have a superior creep property at high temperatures and are suitable candidates to be used in components which are used at a high temperature and in a highly stressed state, such as a turbine blade and a turbine vane of, for example, a jet engine and a gas turbine.

BACKGROUND ART

Conventionally, a Ni-base directionally solidified superalloy and a Ni-base single-crystal superalloy have been known as a Ni base superalloy. For example, Rene80 (an alloy consisting essentially of 9.5 percent by weight of Co, 14.0 percent by weight of Cr, 4.0 percent by weight of Mo, 4.0 percent by weight of W, 3.0 percent by weight of Al, 17.0 percent by weight of Co, 0.015 percent by weight of B, 5.0 percent by weight of Ti, 0.03 percent by weight of Zr, and Ni as a balance), and Mar-M247 (an alloy consisting essentially of 10.0 percent by weight of Co, 8.5 percent by weight of Cr, 0.65 percent by weight of Mo, 10.0 percent by weight of W, 5.6 percent by weight of Al, 3.0 percent by weight of Ta, 1.4 percent by weight of Hf, 0.16 percent by weight of C, 0.015 percent by weight of B, 1.0 percent by weight of Ti, 0.04 percent by weight of Zr, and Ni as a balance) have been known as a directionally solidified superalloy. Moreover, TMD-103 (Japanese Patent No. 2,905,473) has been known as a third generation Ni-base directionally solidified superalloy.

These conventional Ni-base directionally solidified superalloys is inferior in strength at high temperatures to a Ni-base single-crystal alloy, but they are good in manufacturing yield due to less occurrences of grain misorientation and less cracking at casting and excellent in a point that complex heat treatment is not required. However, strength of a Ni-base directionally solidified superalloy has been required to be improved for practical use. Moreover, a Ni-base directionally solidified superalloy in strength at a high temperature has been desired because rise of turbine inlet temperature is the most efficient in order to improve efficiency of a gas turbine.

Similarly, a Ni-base single-crystal superalloy with further excellent strength at a high temperature has been also desired, though a Ni-base single-crystal superalloy, which is produced by casting, has superior strength at a high temperature.

DISCLOSURE OF THE INVENTION

In order to solve the above-mentioned problems, a first aspect of the present invention is to provide a Ni-base directionally solidified superalloy consisting essentially of from 5.0 percent by weight to 7.0 percent by weight of Al, from 4.0 percent by weight to 16.0 percent by weight of Ta+Nb+Ti, from 1.0 percent by weight to 4.5 percent by weight of Mo, from 4.0 percent by weight to 8.0 percent by weight of W, from 3.0 percent by weight to 8.0 percent by weight of Re, 2.0 percent by weight or less of Hf, 10.0 percent by weight or less of Cr, 15.0 percent by weight or less of Co, from 1.0 percent by weight to 4.0 percent by weight of Ru, 0.2 percent by weight or less of C, 0.03 percent by weight or less of B and Ni and inevitable impurities as a balance. According to a second aspect of the present invention, there is provided a Ni-base directionally solidified superalloy including from 2.8 percent by weight to 4.5 percent by weight of Mo in the above-mentioned composition. According to a third aspect of the present invention, there is provided a Ni-base directionally solidified superalloy including from 4.0 percent by weight to 6.0 percent by weight of Ta in the above-mentioned composition. According to a fourth aspect of the present invention, there is provided a Ni-base directionally solidified superalloy consisting essentially of from 5.8 percent by weight to 6.0 percent by weight of Al, from 5.5 percent by weight to 6.5 percent by weight of Ta+Nb+Ti, from 2.8 percent by weight to 3.0 percent by weight of Mo, from 5.5 percent by weight to 6.5 percent by weight of W, from 4.8 percent by weight to 5.0 percent by weight of Re, from 0.08 percent by weight to 0.12 percent by weight of Hf, from 2.0 percent by weight to 5.0 percent by weight of Cr, from 5.5 percent by weight to 6.0 percent by weight of Co, from 1.8 percent by weight to 2.2 percent by weight of Ru, from 0.05 percent by weight to 0.1 percent by weight of C, from 0.01 percent by weight to 0.02 percent by weight of B, and Ni and inevitable impurities as a balance.

According to a fifth aspect of the invention, there is provided a Ni-base directionally solidified superalloy including from 0.01 percent by weight to 0.1 percent by weight of Si in the above-described compositions. According to a sixth aspect of the invention, there is provided a Ni-base directionally solidified superalloy further including one or more elements selected from the group consisting of 2.0 percent by weight or less of V, 1.0 percent by weight or less of Zr, 0.2 percent by weight or less of Y, 0.2 percent by weight or less of La, and 0.2 percent by weight or less of Ce in the above-mentioned compositions.

Moreover, a seventh aspect of the present invention is to provide a Ni-base single-crystal superalloy consisting essentially of from 5.0 percent by weight to 7.0 percent by weight of Al, from 4.0 percent by weight to 16.0 percent by weight of Ta+Nb+Ti, from 1.0 percent by weight to 4.5 percent by weight of Mo, from 4.0 percent by weight to 8.0 percent by weight of W, from 3.0 percent by weight to 8.0 percent by weight of Re, 2.0 percent by weight or less of Hf, 10.0 percent by weight or less of Cr, 15.0 percent by weight or less of Co, from 1.0 percent by weight to 4.0 percent by weigh of Ru, 0.2 percent by weight or less of C, 0.03 percent by weight or less of B, and Ni and inevitable impurities as a balance. According to an eighth aspect of the present invention, there is provided a Ni-base single-crystal superalloy including from 2.8 percent by weight to 4.5 percent by weight of Mo in the above-mentioned composition. According to a ninth aspect of the present invention, there is provided a Ni-base single-crystal superalloy including from 4.0 percent by weight to 6.0 percent by weight of Ta in the above-mentioned compositions. According to a tenth aspect of the present invention, there is provided a Ni-base single-crystal superalloy consisting essentially of from 5.8 percent by weight to 6.0 percent by weight of Al, from 5.5 percent by weight to 6.5 percent by weight of Ta+Nb+Ti, from 2.8 percent by weight to 3.0 percent by weight of Mo, from 5.5 percent by weight to 6.5 percent by weight of W, from 4.8 percent by weight to 5.0 percent by weight of Re, from 0.08 percent by weight to 0.12 percent by weight of Hf, from 2.0 percent by weight to 5.0 percent by weight of Cr, from 5.5 percent by weight to 6.0 percent by weight of Co, from 1.8 percent by weight to 2.2 percent by weight of Ru, from 0.05 percent by weight to 0.1 percent by weight of C, from 0.01 percent by weight to 0.02 percent by weight of B, and Ni and inevitable impurities as a balance.

Furthermore, an eleventh aspect of the present invention is to provide a Ni-base single-crystal superalloy including from 0.01 percent by weight to 0.1 percent by weight of Si in the above-mentioned compositions. According to a twelfth aspect of the invention, there is provided a Ni-base single-crystal superalloy including one or more elements selected from the group consisting of 2.0 percent by weight or less of V, 1.0 percent by weight or less of Zr, 0.2 percent by weight or less of Y, 0.2 percent by weight or less of La, and 0.2 percent by weight or less of Ce in the above-mentioned compositions.

Figure 1:
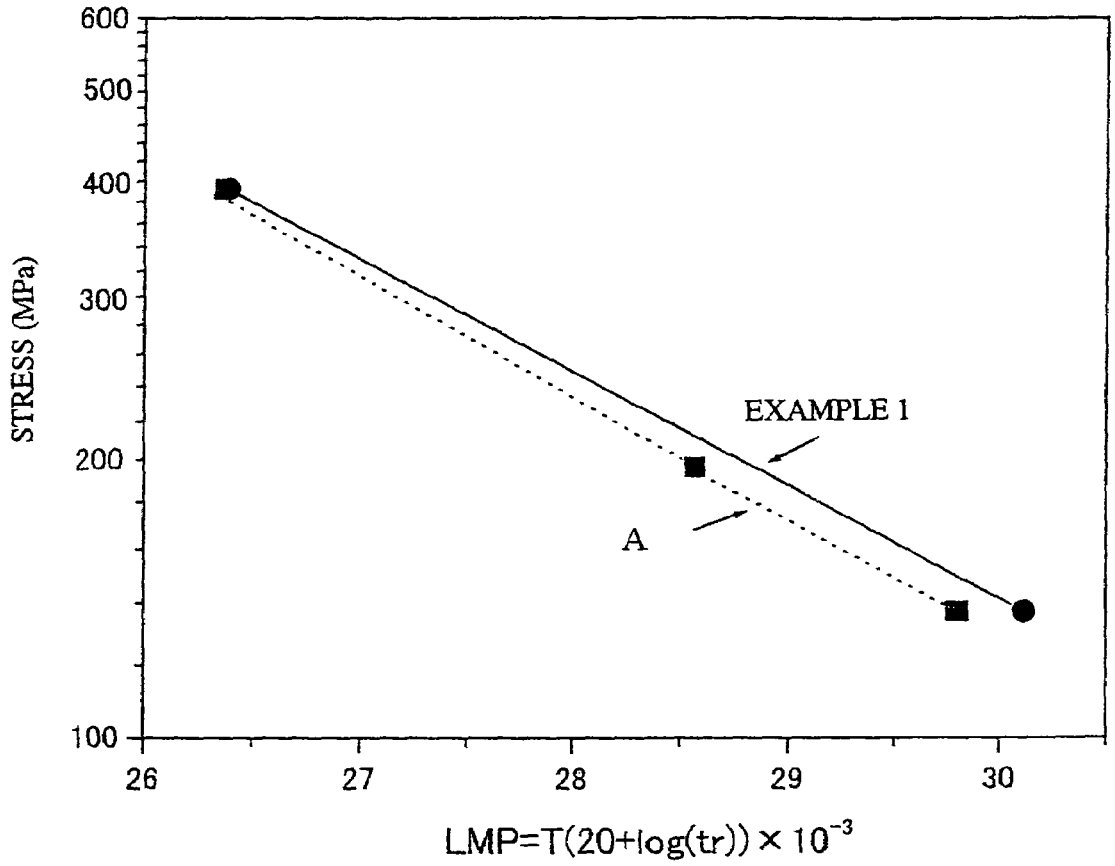
FIG. 1 is a view showing results of creep tests for a Ni-base directionally solidified superalloy according to EXAMPLE 1 and for a conventional one, using the Larson-Miller parameters.

Here, symbols in the drawings are defined as follows:

A TMD-103 (a third generation Ni-base directionally solidified superalloy);

B Mar-M247 (a commercial Ni-base directionally solidified superalloy); and

C Rene80 (a commercial Ni-base directionally solidified superalloy).

Figure 3:
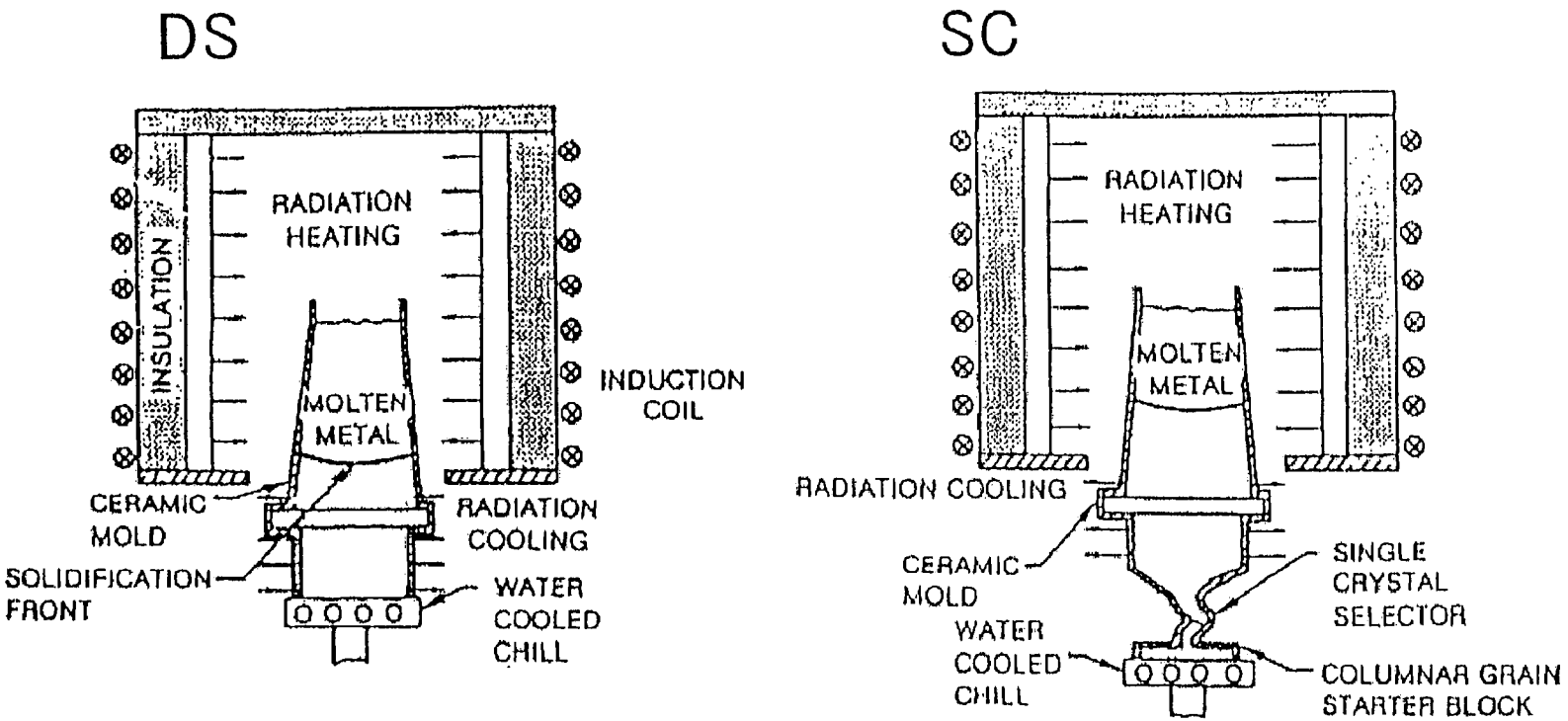

FIG. 3 is a schematic view of a casting apparatus and a method to produce a Ni-base directionally solidified superalloy and a Ni-base single-crystal superalloy according to the present invention.

BEST MODE FOR CARRYING OUT THE INVENTION

The present invention provides a Ni-base directionally solidified superalloy and a Ni-base single-crystal superalloy with the above-mentioned features. Embodiments of the invention will be explained.

A Ni-base directionally solidified superalloy and a Ni-base single crystal superalloy have a γ phase (matrix) as an austenite phase and a γ' phase (precipitated phase) as an intermediate phase which is precipitated and dispersed in the parent phase. The γ' phase consists essentially of an intermetallic compound represented by $Ni_3Al$ and the existence of the γ' phase improves strength at a high temperature of a Ni-base directionally solidified superalloy and a Ni-base single crystal superalloy.

The reason for limiting compositions of a Ni-base directionally solidified superalloy and a Ni-base single crystal superalloy of the present invention will be explained as follows.

Cr is an element with excellent oxidation resistance to improve the corrosion resistance at a high temperature. Cr (chromium) is effective for further improving the oxidation resistance and can be added to 10 percent by weight by adjusting addition of Ru. The content of Cr is preferably 10.0 percent by weight or less, and, most preferably, from 2.0 percent by weight to 5.0 percent by weight. It is not preferable that Cr is not contained, because desired corrosion resistance at a high temperature cannot be obtained. It is not preferable that in the case where the content of Cr exceeds 10.0 percent by weight, precipitation of γ' phase is suppressed and a harmful phase such as a σ phase and μ phase is formed to decrease strength at a high temperature.

Mo (molybdenum) is dissolved into a y matrix under coexistence of W and Ta to increase strength at a high temperature, and contributes to strength at a high temperature by precipitation hardening. The content of Mo is preferably from 1.0 percent by weight to 4.5 percent by weight, more preferably, from 2.8 percent by weight to 4.5 percent by weight, and, most preferably, from 2.8 percent by weight to 3.0 percent by weight. It is not preferable that in the case where the content of Mo is less than 1.0 percent by weight, desired strength at a high temperature cannot be obtained. Moreover, it is not preferable that in the case where the content of Mo exceeds 4.5 percent by weight, not only strength at a high temperature is reduced but also corrosion resistance at a high temperature is reduced.

W (tungsten) improves strength at a high temperature by solid solution strengthening and precipitation hardening under coexistence of Mo and Ta. The content of W is preferably from 4.0 percent by weight to 8.0 percent by weight, and, most preferably, from 5.5 percent by weight to 6.5 percent by weight. It is not preferable that in the case where the content of W is less than 4.0 percent by weight, desired strength at a high temperature cannot be obtained. It is not preferable that in the case where the content of W exceeds 8.0 percent by weight, corrosion resistance at a high temperature is reduced.

Ta (tantalum), Nb (niobium), and Ti (titanium) improves strength at a high temperature by solid solution strengthening and precipitation strengthening under coexistence of Mo and W. Moreover, some of them improves high temperature strength by forming precipitates in the γ' phase. The content of Ta+Nb+Ti is up to 16 percent by weight by adjusting each component, preferably, from 4.0 percent by weight to 16.0 percent by weight. The content is more preferably from 4.0 percent by weight to 10.0 percent by weight, and, most preferably, from 5.5 percent by weight to 6.5 percent by weight. It is not preferable that in the case where the content of Ta+Nb+Ti is less than 4.0 percent by weight, desired strength at a high temperature cannot be obtained. It is not preferable that in the case where the content of Ta+Nb+Ti exceeds 16.0 percent by weight, a harmful phase such as a σ phase and a μ phase is formed to decrease strength at a high temperature.

Al (aluminum) combines with Ni (nickel) to form an intermetallic compound represented by $Ni_3Al$. Finely and uniformly dispersed γ' precipitates are composed of this intermetallic compound. The formation of an alloy with these γ' phase with a volume fraction of from 60% to 70% results in an improvement in strength at high temperatures. The content of Al is preferably from 5.0 percent by weight to 7.0 percent by weight, and, most preferably, from 5.8 percent by weight to 6.0 percent by weight. It is not preferable that in the case where the content of Al is less than 5.0 percent by weight, a precipitated amount of the γ' phase becomes not enough and desired strength at a high temperature cannot be obtained. It is not also preferable that in the case where the content of Al exceeds 7.0 percent by weight, many of coarse γ phases called as an eutectic γ' phase are formed to make performing solution heat treatment impossible and high strength at a high temperature cannot be obtained.

Hf (hafnium) is a grain boundary segregation element which is segregated at a grain boundary between a γ phase and a γ' phase to strengthen the boundary. Thereby, strength at a high temperature is improved. The content of Hf is preferably 2.0 percent by weight or less and, more preferably, from 0.08 percent by weight to 0.12 percent by weight. It is not preferable that in the case where Hf is not contained, a grain boundary is not sufficiently strengthened and therefore desired strength at a high temperature cannot be obtained. It is not also preferable that in the case where the content of Hf exceeds 2.0 percent by weight, there is a possibility that local melting is caused to decrease strength at a high temperature.

Co (cobalt) raises a solid solution limit of Al, Ta and the like into a parent phase under a high temperature and causes a fine γ' phase to be precipitated and dispersed by heat treating. Thereby, strength at a high temperature is improved. The content of Co is preferably 15.0 percent by weight or less and, more preferably, from 5.5 percent by weight to 6.0 percent by weight. It is not preferable that in the case where Co is not contained, a precipitated amount of a γ' phase becomes not enough and therefore desired strength at a high temperature cannot be obtained. It is not also preferable that in the case where the content of Co exceeds 15.0 percent by weight, balance between Co and other elements such as Al, Ta, Mo, W, Hf and Cr is lost to cause a harmful phase to be precipitated and strength at a high temperature is decreased.

Re (rhenium) is dissolved into a γ phase of a parent phase to improve strength at a high temperature by solid solution strengthening. Corrosion resistance is also improved. On the other hand, addition of a large amount of Re causes strength at a high temperature to be decreased, because a TCP phase, which is a harmful phase, is precipitated at a high temperature. Re can be added up to 8 percent by weight by adjusting the addition amount of Ru. The content of Re is preferably from 3.0 percent by weight to 8.0 percent by weight and, more preferably, from 4.8 percent by weight to 5.0 percent by weight. It is not preferable that in the case where the content of Re is less than 3.0 percent by weight, solid solution strengthening of a γ phase becomes not enough and desired strength at a high temperature cannot be obtained. It is not also preferable that in the case where the content of Re exceeds 6.0 percent by weight, a TCP phase is precipitated at a high temperature and high strength at a high temperature can not be obtained.

Ru is one of elements which characterize the present invention and suppresses precipitation of a TCP phase to improve strength at a high temperature. The content of Ru is preferably from 1.0 percent by weight to 4.0 percent by weight and, more preferably, from 1.8 percent by weight to 2.2 percent by weight. It is not preferable that in the case where the content of Ru is less than 1.0 percent by weight, a TCP phase is precipitated at a high temperature and high strength at a high temperature cannot be obtained. It is not also preferable that in the case where the content of Ru exceeds 4.0 percent by weight, cost is high.

C (carbon) contributes to strengthening of a grain boundary. The content of C is preferably 0.2 percent by weight and or less, more preferably, from 0.05 percent by weight to 0.1 percent by weight. It is not preferable that in the case where C is not contained, an effect of strengthening of a grain boundary cannot be obtained. It is not also preferable that in the case where the content of C exceeds 0.2 percent by weight, ductility is deteriorated.

B (boron) contributes to strengthening of a grain boundary in a similar manner to that of C. The content of B is preferably 0.03 percent by weight or less and, more preferably, from 0.01 percent by weight to 0.02 percent by weight. It is not preferable that in the case where the content of B is less than 0.01 percent by weight, an effect of strengthening of a grain boundary cannot be obtained. It is not also preferable that in the case where the content of B exceeds 0.03 percent by weight, ductility is deteriorated.

Si (silicon) is an element which forms an $SiO_2$ film on a surface of an alloy as a protective film to improve oxidation resistance. Though silicon has been treated as an impurity element so far, silicon is intentionally contained and is effectively used for improving oxidation resistance in present invention. Moreover, it is considered that cracks hardly occur in the $SiO_2$ film in comparison with other protective oxide films and the $SiO_2$ film has an effect to improve creep and fatigue properties. However, the content of silicon has been limited to from 0.01 percent by weight to 0.1 percent by weight, because addition of a large amount of silicon lowers solid solution limits of other elements.

In a Ni-base directionally solidified superalloy and a Ni-base single-crystal superalloy according to the present invention, at least one of V, Zr, Y, La, or Ce is added to the composition.

V (vanadium) is an element which is dissolved into a γ' phase and strengthens a γ' phase. However, the content of V is limited to 2.0 percent by weight or less because excessive addition of V decreases creep strength.

Zr (zirconium) is an element which strengthens a grain boundary in a similar manner to that of B and C. However, the content of Zr is limited to 1.0 percent by weight or less because excessive addition of Zr decreases creep strength.

Each of Y (yttrium), La (lanthanum), and Ce (cerium) is an element which improves adhesiveness of the film that forms protective oxide film, such as alumina and chromia, during high heat operations. However, the contents of Y, La, and Ce are limited to 0.2 percent by weight or less, respectively, because excessive addition of them lowers solid solution limits of other elements.

A Ni-base directionally solidified superalloy and a Ni-base single-crystal superalloy according to the present invention can be produced as a product with a composition of predetermined elements by casting, considering procedures and conditions of a well-known process. The attached drawing of FIG. 3 is an outline view illustrating a process for a directionally solidified superalloy (DS) and a single crystal superalloy. It is seen from FIG. 3 that a single crystal superalloy is a modification of a directionally solidified superalloy. That is, a metal and an alloy produced by casting usually have a polycrystalline structure in which crystals are disposed in all directions. A directionally solidified alloy is composed of a cluster of slender crystalline grains, called as a columnar crystal, an orientation of which is arranged in a loading direction. A single crystal alloy is obtained as an extension of a directionally solidified alloy by selecting one of the columnar crystals for growth. Accordingly, a single crystal alloy also has a structure in which an orientation of crystals is arranged in a loading direction. A single crystal alloy is produced by an apparatus shown at the right of FIG. 3. The apparatus is different from an apparatus, which is shown at the left of FIG. 3, for a directionally solidified alloy only in a point that a selector for selecting a crystal is provided. Both of the apparatuses are same, except the above point.

A Ni-base single-crystal superalloy can be obtained as a single crystal by using a selector for growing one crystal in production of a Ni-base directionally solidified superalloy.

Hereinafter, examples will be shown for further detailed explanation. It is obvious that the present invention is not limited to the following examples.

EXAMPLES

Example 1

A cast of a directionally solidified alloy, which consists of 5.8 percent by weight of Co, 2.9 percent by weight of Cr, 2.9 percent by weight of Mo, 5.8 percent by weight of W, 5.8 percent by weight of Al, 5.8 percent by weight of Ta, 0.10 percent by weight of Hf, 4.9 percent by weight of Re, 2.0 percent by weight of Ru, 0.07 percent by weight of C, 0.015 percent by weight of B, and Ni and inevitable impurities as a balance was obtained by melting and casting with a solidification rate of 200 mm/h in a vacuum. Cylindrical test pieces (Nos. 1 and 2) with a diameter of 4 mm and a length of 20 mm were made from the cast of a directionally solidified alloy and creep tests were conducted according to conditions shown in TABLE 1. Pieces of data with regard to rupture life, elongation, and reduction are shown in TABLE 1.

Moreover, values of the Larson-Miller parameter were calculated according to the following formula and are shown in TABLE 1.

$$LMP=T(20+\log(tr))\times10^{-3}$$

where T: Kelvin temperatures, and tr: Rupture life in hours. A relation between an LMP value and a stress is shown in FIG. 1 in comparison with that of existing TMD-103.

A in the drawing represents a case of the TMD-103. In FIG. 1, an upper-left portion represents results at a low temperature and under a high stress and a lower-right portion represents results at a high temperature and under a low stress. When a curve is situated in a right side, creep strength is higher.

It is obvious from FIG. 1 that a Ni-base directionally solidified superalloy according to EXAMPLE 1 is superior in creep strength at a high temperature.

Example 2

After preheating of a cast of a directionally solidified alloy which has been obtained in a similar manner to that of EXAMPLE 1 was conducted at a temperature of 1300° C. for one hour in a vacuum, solution heat treatment was performed. That is, the cast was heated to 1320° C., was maintained at the temperature for five hours and then was cooled by air. After the above step, two-step aging treatment was conducted. That is, as a first step, the cast was maintained at 1100° C. for four hours in a vacuum and then was cooled by air. Subsequently, as a second step, the cast was maintained at 870° C. for twenty hours in a vacuum and then air cooling was executed.

Test pieces (Nos. 3 to 5) were made in a similar manner to that of EXAMPLE 1 and creep tests were conducted according to conditions shown in TABLE 1. Pieces of data with regard to life, elongation, and reduction are shown in TABLE 1. LMP values are shown in TABLE 1 and FIG. 2.

It is seen from FIG. 1 that the Ni-base directionally solidified superalloy according to EXAMPLE 2 is superior in creep strength to that of EXAMPLE 1.

Figure 2:
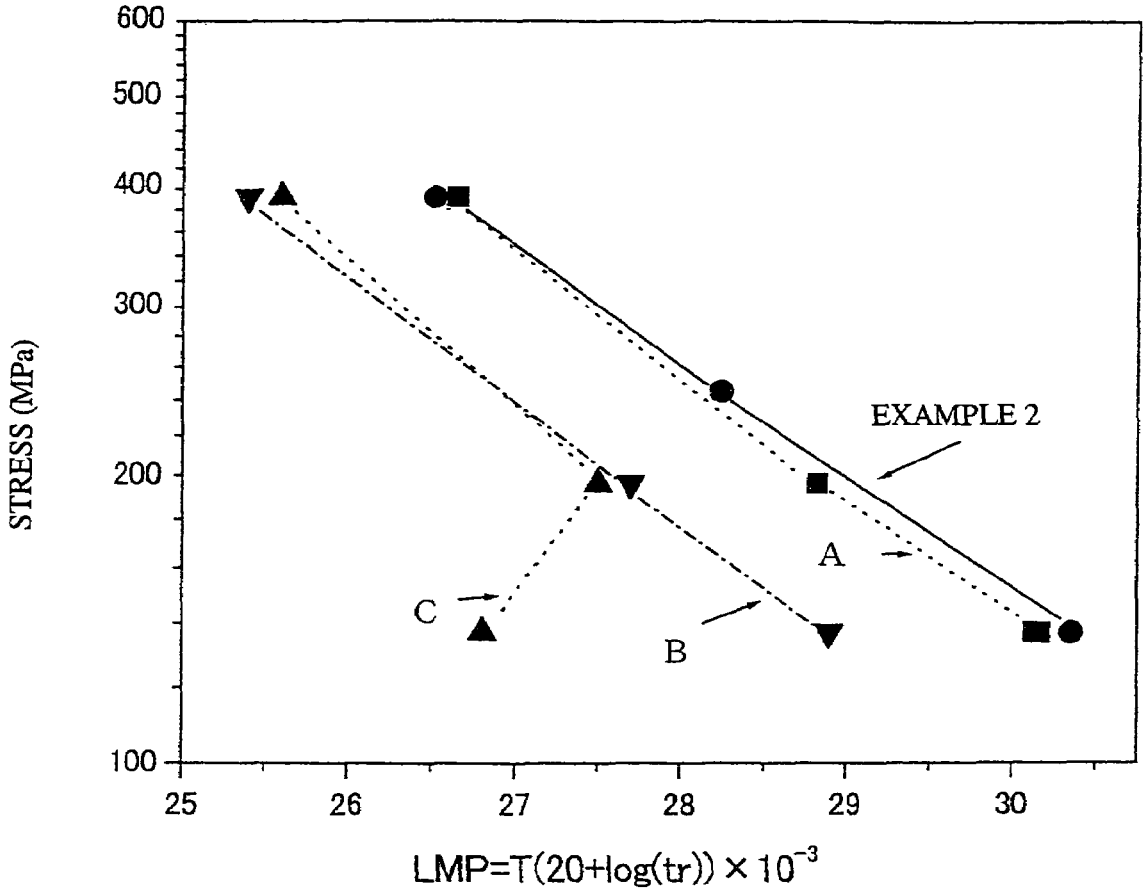
FIG. 2 is a view showing results of creep tests for a Ni-base directionally solidified superalloy according to EXAMPLE 2 and a conventional one, using the Larson-Miller parameters.

Further, it is understood from FIG. 2 that the Ni-base directionally solidified superalloy according to EXAMPLE 2 is remarkably more excellent in creep strength over a wide range of temperatures in comparison with commercial Ni-base directionally solidified superalloys, Rene80 (C) and Mar-M247 (B).

Example 3

It was confirmed that creep strength of a single crystal superalloy with a similar composition to that of EXAMPLE 1 was superior to that of EXAMPLE 2 because life of the superalloy according to EXAMPLE 3 was improved two or three times longer than that in EXAMPLE 2.

INDUSTRIAL APPLICABILITY

A Ni-base directionally solidified superalloy according to the present invention, containing a Ru element, is an alloy with more improved creep strength at further higher temperatures in comparison with that of a third-generation Ni-base directionally solidified superalloy which does not contain a Ru element. Accordingly, when the superalloy according to the present invention is used for a turbine blade, a turbine vane and the like in a jet engine, an industrial gas turbine and the like, they can be used in combustion gas at a higher temperature.

Moreover, a Ni-base single-crystal superalloy according to the present invention is superior in strength at a high temperature and has improved casting properties and good manufacturing yield.

TABLE 1

| Test piece (No.) | Temperature (° C.) | Stress (kgf/mm2) | Life (h) | Elongation (%) | Reduction (%) | LMP P = 20 (×1000) |
|---|---|---|---|---|---|---|
| 1 | 900 | 40 | 310.6 | 13.4 | 14.3 | 26.387 |
| 2 | 1100 | 14 | 85.3 | 16.7 | 37.8 | 30.114 |
| 3 | 900 | 40 | 402.2 | 10.1 | 15.1 | 26.519 |
| 4 | 1000 | 25 | 152.5 | 14.9 | 15.9 | 28.243 |
| 5 | 1100 | 14 | 126.3 | 14.9 | 26.3 | 30.349 |

The invention claimed is:

1. A Ni-base directionally solidified superalloy consisting essentially of from 5.0 percent by weight to 7.0 percent by weight of Al, from 4.0 percent by weight to 16.0 percent by weight of Ta+Nb+Ti, wherein Ta is from 4.0 percent by weight to 5.8 percent by weight, from 1.0 percent by weight to 4.5 percent by weight of Mo, from 4.0 percent by weight to 8.0 percent by weight of W, from 3.0 percent by weight to 8.0 percent by weight of Re, 2.0 percent by weight or less of Hf, 10.0 percent by weight or less of Cr, 15.0 percent by weight or less of Co, from 1.0 percent by weight to 4.0 percent by weight of Ru, from 0.07 percent by weight to 0.2 percent by weight of C, from 0.015 percent by weight to 0.03 percent by weight of B, and Ni, and inevitable impurities as a balance.

2. The Ni-base directionally solidified superalloy as claimed in claim 1, wherein the superalloy includes from 2.8 percent by weight to 4.5 percent by weight of Mo.

3. The Ni-base directionally solidified superalloy as claimed in claim 1, wherein the super alloy consists essentially of from 5.8 percent by weight to 6.0 percent by weight of Al, from 5.5 percent by weight to 6.5 percent by weight of Ta+Nb+Ti, from 2.8 percent by weight to 3.0 percent by weight of Mo, from 5.5 percent by weight to 6.5 percent by weight of W, from 4.8 percent by weight to 5.0 percent by weight of Re, from 0.08 percent by weight to 0.12 percent by weight of Hf, from 2.0 percent by weight to 5.0 percent by weight of Cr, from 5.5 percent by weight to 6.0 percent by weight of Co, from 1.8 percent by weight to 2.2 percent by weight of Ru, from 0.07 percent by weight to 0.015 percent by weight of C, from 0.01 percent by weight to 0.02 percent by weight of B, and Ni and inevitable impurities as a balance.

4. The Ni-base directionally solidified superalloy as claimed in any one of claims 1, 2 or 3, wherein the super alloy includes from 0.01 percent by weight to 0.1 percent by weight of Si.

5. The Ni-base directionally solidified superalloy as claimed in claim 4, wherein the superalloy includes one or more elements selected from the group consisting of 2.0 percent by weight or less of V, 1.0 percent by weight or less of Zr, 0.2 percent by weight or less of Y, 0.2 percent by weight or less of La, and 0.2 percent by weight or less of Ce.

6. The Ni-base directionally solidified superalloy as claimed in any one of claims 1, 2, or 3, wherein the superalloy includes one or more elements selected from the group consisting of 2.0 percent by weight or less of V, 1.0 percent by weight or less of Zr, 0.2 percent by weight or less of Y, 0.2 percent by weight or less of La, and 0.2 percent by weight or less of Ce.

7. A Ni-base single-crystal superalloy consisting essentially of from 5.0 percent by weight to 7.0 percent by weight of Al, from 4.0 percent by weight to 16.0 percent by weight of Ta+Nb+Ti wherein Ta is from 4.0 percent by weight to 5.8 percent by weight, from 1.0 percent by weight to 4.5 percent by weight of Mo, from 4.0 percent by weight to 8.0 percent by weight of W, from 3.0 percent by weight to 8.0 percent by weight of Re, 2.0 percent by weight or less of Hf, 10.0 percent by weight or less of Cr, 15.0 percent by weight or less of Co, from 1.0 percent by weight to 4.0 percent by weigh of Ru, from 0.07 percent by weight to 0.2 percent by weight of C, from 0.015 percent by weight to 0.02 percent by weight of B, and Ni and inevitable impurities as a balance.

8. The Ni-base single-crystal superalloy as claimed in claim 7, wherein the superalloy includes from 2.8 percent by weight to 4.5 percent by weight of Mo.

9. The Ni-base single-crystal superalloy as claimed in claim 7, wherein the superalloy consists essentially of from 5.8 percent by weight to 6.0 percent by weight of Al, from 5.5 percent by weight to 6.5 percent by weight of Ta+Nb+Ti, from 2.8 percent by weight to 3.0 percent by weight of Mo, from 5.5 percent by weight to 6.5 percent by weight of W, from 4.8 percent by weight to 5.0 percent by weight of Re, from 0.08 percent by weight to 0.12 percent by weight of Hf, from 2.0 percent by weight to 5.0 percent by weight of Cr, from 5.5 percent by weight to 6.0 percent by weight of Co, from 1.8 percent by weight to 2.2 percent by weight of Ru, from 0.07 percent by weight to 0.015 percent by weight of C, from 0.01 percent by weight to 0.02 percent by weight of B, and Ni and inevitable impurities as a balance.

10. The Ni-base single-crystal superalloy as claimed in claim 7, 8 or 9, wherein the superalloy includes one or more elements selected from the group consisting of 2.0 percent by weight or less of V, 1.0 percent by weight or less of Zr, 0.2 percent by weight or less of Y, 0.2 percent by weight or less of La, and 0.2 percent by weight or less of Ce.

11. The Ni-base single-crystal superalloy as claimed in claim 7, wherein the superalloy includes from 0.01 percent by weight to 0.1 percent by weight of Si.

12. The Ni-base single-crystal superalloy as claimed in claim 11, wherein the superalloy includes one or more elements selected from the group consisting of 2.0 percent by weight or less of V, 1.0 percent by weight or less of Zr, 0.2 percent by weight or less of Y, 0.2 percent by weight or less of La, and 0.2 percent by weight or less of Ce.

* * * * *